US006175970B1

(12) United States Patent
Pinciaro

(10) Patent No.: US 6,175,970 B1
(45) Date of Patent: Jan. 23, 2001

(54) TOWEL WARMING SYSTEM FOR SPA TUB

(75) Inventor: John Pinciaro, Monroe, CT (US)

(73) Assignee: Precision Design Concepts Ltd., Woodbridge, CT (US)

( * ) Notice: Under 35 U.S.C. 154(b), the term of this patent shall be extended for 0 days.

(21) Appl. No.: 09/394,849

(22) Filed: Sep. 13, 1999

(51) Int. Cl.[7] ..... A61H 33/02; A47K 3/08; A47K 10/10

(52) U.S. Cl. ..... 4/541.4; 4/545; 4/549; 34/202; 219/385; 219/521

(58) Field of Search ..... 4/541.1, 541.4, 4/545, 548, 549, 559, 584; 219/213, 218, 385, 521; 34/202

(56) References Cited

U.S. PATENT DOCUMENTS

| | | | | |
|---|---|---|---|---|
| 2,572,463 | | 10/1951 | Fine | 4/549 |
| 2,714,725 | * | 8/1955 | Boone | 4/549 X |
| 3,381,108 | | 4/1968 | Wuck | 219/213 |
| 4,117,309 | * | 9/1978 | Cayley | 219/385 |
| 4,546,506 | * | 10/1985 | Houle et al. | 4/559 X |
| 4,644,136 | | 2/1987 | Watchman | 291/400 |
| 4,849,610 | | 7/1989 | Alvarez | 219/521 |
| 4,927,995 | | 5/1990 | Lovett et al. | 219/385 |
| 4,942,630 | * | 7/1990 | Kantor et al. | 4/541.1 X |
| 5,172,754 | | 12/1992 | Graber et al. | 165/47 |
| 5,345,996 | | 9/1994 | Druien | 165/47 |
| 5,548,100 | | 8/1996 | Miller | 219/521 |
| 5,642,462 | | 6/1997 | Huff | 392/382 |
| 5,718,007 | * | 2/1998 | Loyd | 4/541.1 |

FOREIGN PATENT DOCUMENTS

| | | | | |
|---|---|---|---|---|
| 2214801 | * | 9/1989 | (GB) | 4/545 |

* cited by examiner

*Primary Examiner*—Henry J. Recla
*Assistant Examiner*—Kathleen J. Prunner
(74) *Attorney, Agent, or Firm*—David P. Gordon; David S. Jacobson; Thomas A Gallagher

(57) ABSTRACT

A spa enclosure for a spa tub is provided with a cabinet having at least one towel bar or towel hook and which at least partially recesses into the wall of the enclosure. The cabinet is provided with vent openings which permit heat cogenerated by a water pump used to pump water in the spa, an air blower, and/or a water heater to enter the cabinet by convection, heat towels provided on the bars or hooks, and exit through an upper portion of the cabinet. No additional dedicated heating element is provided to heat the towels. According to one preferred embodiment of the invention, the cabinet is hinged at a lower portion to the enclosure and pivots about the hinge to open. The front and sides of the cabinet are preferably insulated to retain heat within the cabinet, and likewise, the enclosure may be insulated. A supply of towels may be kept in the cabinet or towels may be placed in the cabinet just prior to entering the spa tub. In either case, after using the spa tub, the towels will be warm and comfortable to the user.

26 Claims, 6 Drawing Sheets

TOWEL WARMING SYSTEM FOR SPA TUB

BACKGROUND OF THE INVENTION

1. Field of the Invention

This invention relates broadly to spa tubs. More particularly, this invention relates to enclosures which surround a hydrotherapy spa tub.

2. State of the Art

Spa tubs are generally relatively deep rotationally-molded, blow-molded or vacuum-formed tubs provided with an external decorative enclosure surrounding the tub. The tubs are provided with a number of fixtures including water jet fixtures which are operated by a water pump and/or air jet fixtures which are operated by an air blower. The water pump and/or the air blower are housed between the tub and the enclosure.

The appeal of hot tubs and spas is primarily due to the hydrotherapy and bubbling action provided by water jet fixture and/or air jet fixtures recessed into the tub wall which provide a massaging action. In addition, unlike a bath tub which may be fitted with the fixtures but must be filled and emptied with each use, a spa tub is intended to retain the water provided therein over many uses, and preferably continually maintains the water at a heated temperature, e.g., 98 to 108 degrees Fahrenheit. This is accomplished by providing a water jacket around the water pump which utilizes heat generated by the water pump to heat the water and/or by utilizing a separate water heater element. Therefore, the spa tub is always ready for immediate use. Further, because the water is always warm, spa tubs may be used indoors and outdoors throughout the year.

One problem, particularly with the outdoor use of the spa tub, is that upon emerging from the tub, the air temperature and therefore the towels left outside the tub are substantially colder than the water temperature. Therefore, the soothing relaxation provided by the spa tub is abruptly countered with the discomfort of the relatively cold towels for drying oneself upon leaving the tub.

SUMMARY OF THE INVENTION

It is therefore an object of the invention to provide a system to warm towels in the enclosure about a spa tub.

It is another object of the invention to provide a towel warming system which includes a cabinet in the enclosure.

It is a further object of the invention to provide a towel warming system which requires no dedicated heating element.

It is an additional object of the invention to provide a towel warming system which utilizes convection heat cogenerated by one or more of the water pump which operates hydrotherapy fixtures, an air blower which provides air to air jet fixtures, a water heater, and the heated water within the spa tub, hereinafter collectively 'the cogenerated heat' of the spa tub system.

In accord with these objects, which will be discussed in detail below, a spa enclosure of a spa tub system is provided with a towel storage device having at least one towel bar or towel hook and which is movable at least partially into and out of the enclosure between open and closed positions. The towel storage device is provided with one or more vent openings such that when the storage device is in a closed position, the vent openings permit the cogenerated heat existing within the enclosure to enter the storage device by convection, to heat towels provided on the bars or hooks, and then exit the towel storage device. No additional dedicated heating element is provided to heat the towels.

According to one preferred embodiment of the invention, the storage device is a cabinet hinged at a lower portion to the enclosure and pivotable about the hinge between open and closed positions. The front and sides of the cabinet are preferably insulated to retain heat within the cabinet, and likewise, the enclosure may be at least partially insulated, e.g., with a foam, to retain heat.

According to another embodiment, particularly applicable where the space between the enclosure and the spa tub is at least partially filled with insulative foam, one or more openings in the cabinet are coupled to or provided adjacent first ends of one or more sections of tubing. The tubing extends through the insulative foam and has a second end provided adjacent to or coupled to the water pump, the air blower, and/or the water heater to carry heated exhaust air from the water pump, the air blower, and/or the water heater through the tubing to the cabinet.

According to a further embodiment, the storage cabinet is stationary but includes hinged doors which provide access to the interior of the cabinet and towel bar and/or towel hooks located therein.

A supply of towels may be kept in the cabinet or towels may be placed in the cabinet just prior to entering the spa tub. In either case, after using the spa tub, the towels will be warm and comforting to the user.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
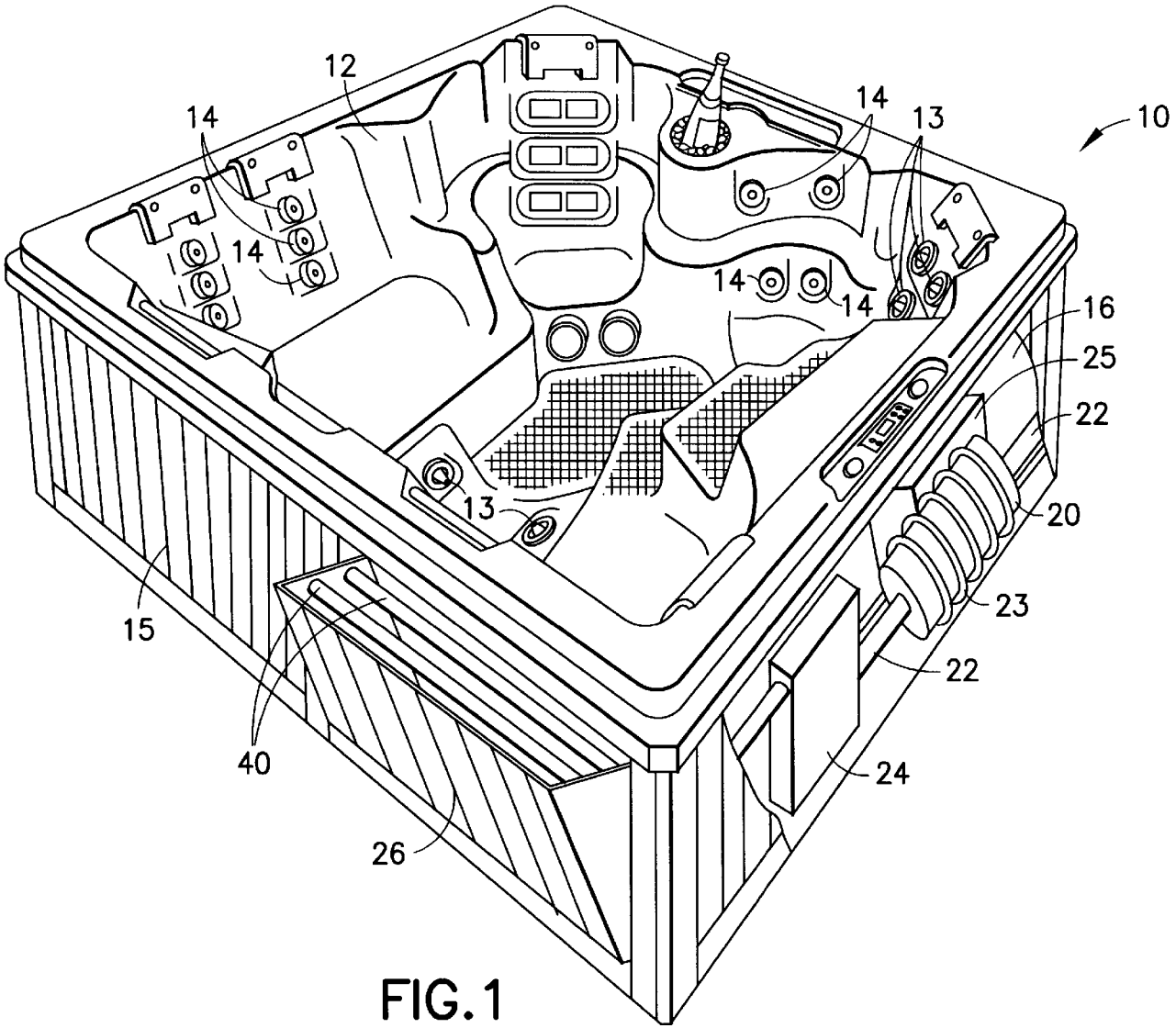
FIG. 1 is a partially broken-away perspective view of a spa tub having an enclosure about its exterior.

Turning now to FIG. 1, a spa tub system 10 including a spa tub 12 is shown. The spa tub 12 is a molded form provided with several hydrotherapy fixtures 13 adapted to direct aerated jets of water at persons seated within the tub. In addition or alternatively, the spa tub 12 may be provided with several air jet fixtures 14 adapted to provide bubbling action to water within the tub. A decorative enclosure 15, made, for example, from wood, plastic or any other suitable material, is provided around the exterior of the spa tub 12, and a space 16 is provided between the spa tub 12 and the enclosure 15. A water pump 20 is situated in the space 16, and is coupled to the hydrotherapy fixtures 13 with flexible tubing 22. The water pump 20 pumps water through the tubing 22 to the hydrotherapy fixtures 13, and the water is returned to the pump via a suction drain fitting in the spa tub. Water plumbing 23 extends around the water pump as a heating jacket to heat the water to the desired temperature. Additionally or alternatively, a separate water heater unit 24 may be used. An air blower 25 is provided in the space 16 to operate the air jet fixtures 14.

Figure 2:
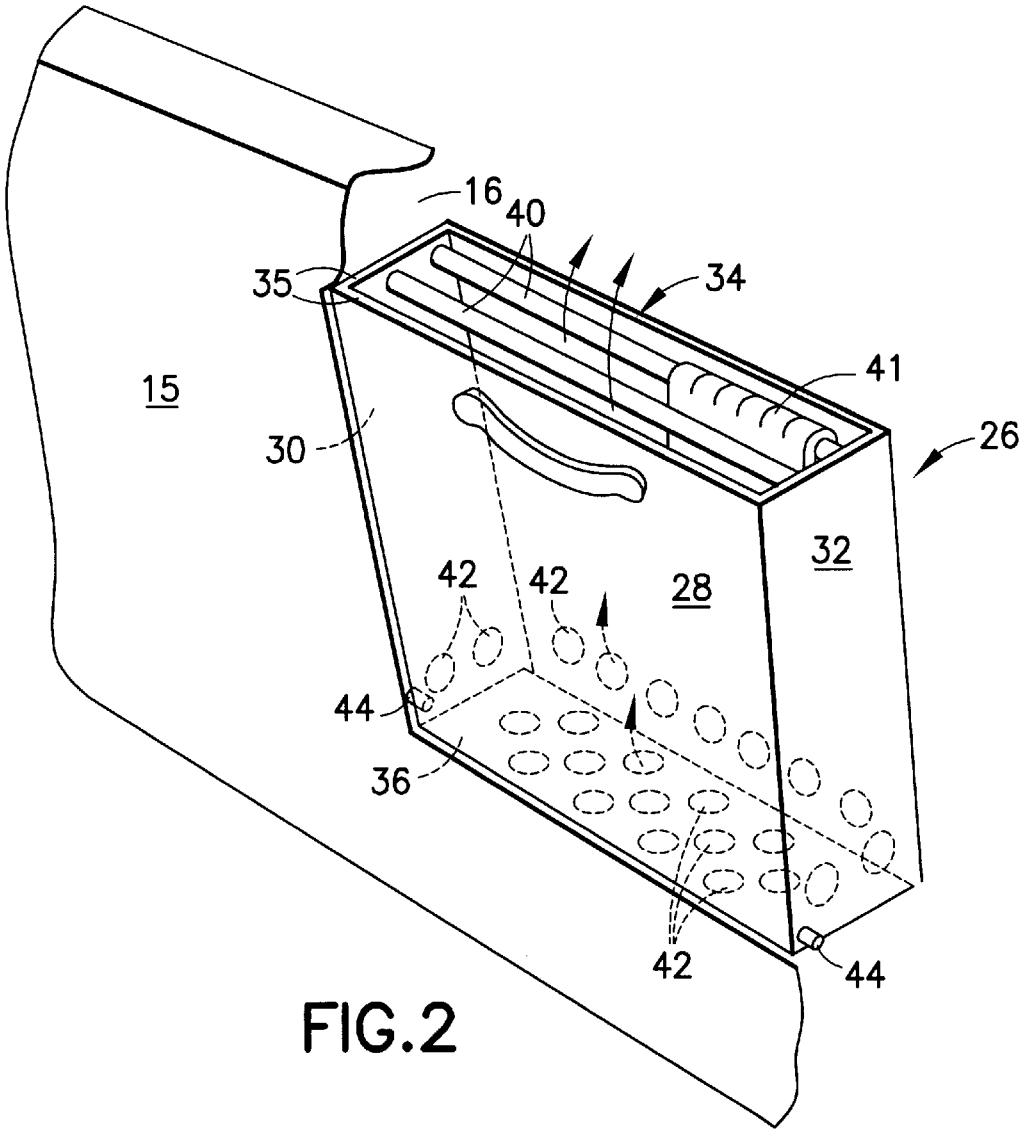
FIG. 2 is a partially broken-away perspective view of a first embodiment of a cabinet portion of a towel warming system according to the invention.

Referring to FIGS. 1 and 2, a cabinet 26 is provided in the enclosure 15. The cabinet includes a front side 28, two lateral sides 30, 32, and preferably a back side 34 and a bottom side 36. The front side 28 and optionally the lateral sides 30, 32 are preferably made from or insulated with a material 35 having a relatively low thermal conductivity. Exemplar materials include fiberglass, foil, bubble wrap, and plastic, though other materials known in the art of insulation may be used. Towel bars 40 extend horizontally between the lateral sides 30, 32 at an upper portion of the cabinet for holding one or more towels 41. The towel bars 40 are preferably removable for gaining access to the bottom of the cabinet. One or more of the bottom side 36, a lower portion of the back side 34, and a lower portion of the lateral sides 30, 32 are provided with vent openings 42. The cabinet 26 is coupled to the enclosure 15 such that the cabinet may be retracted from and at least partially recessed into the enclosure. As such, a pivot arrangement in which pivot pins 44 rotate relative to bearings (not shown) on the enclosure may be used to permit the cabinet to pivot outward relative to the enclosure for the placement and removal of towels on the towel bars 40. Preferably, when closed, the front side 28 lies flush with the enclosure 15.

Warm air cogenerated by the water pump 20, the water heater 24, the air blower 25, and/or the heated water within the tub circulates within the space 16. Thus, as indicated by the arrows of FIG. 2, warm air may enter the lower vent openings 42 and rise through the cabinet 26 to warm towels 41 placed upon the towel bars, exit the top of the cabinet, and return to the space 16 of the enclosure where it is again heated by the pump. Alternatively, the warm air may enter from the top of the cabinet and exit through the vent openings 42. Regardless, no dedicated or additional heating element is required to heat the towels. If desired, a fan (not shown) may be utilized to circulate the warm air.

Figure 3:
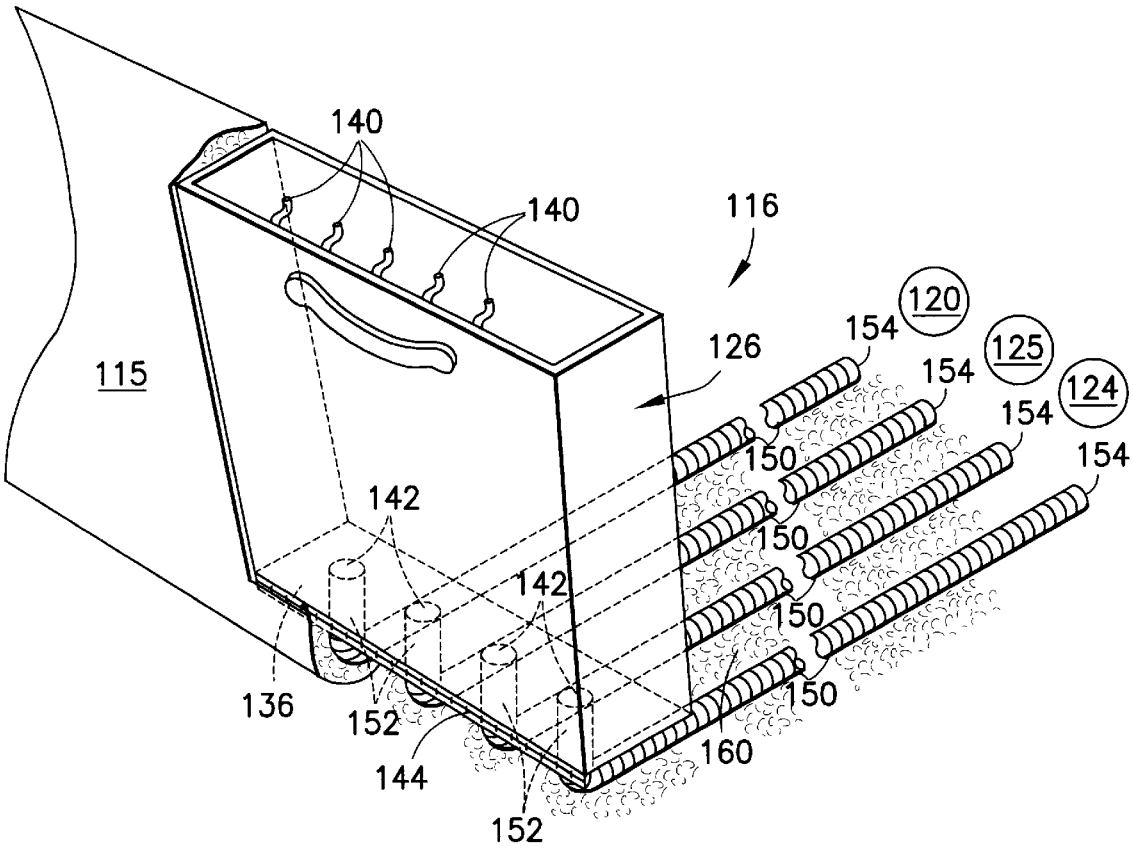
FIG. 3 is a partially broken-away perspective view of a second embodiment of a cabinet portion of a towel warming system according to the invention.

Turning now to FIG. 3, a second embodiment of the cabinet 126, substantially similar to the first embodiment and particularly suitable where the space 116 between the enclosure 115 and the spa tub is at least partially filled with insulative foam 160, is shown. A plurality of vent openings 142 are provided in the bottom side 136 of the cabinet. One or more conduits 150, e.g., flexible PVC tubes, each having first and second ends 152, 154 are provided, with the first ends 152 coupled to or provided adjacent the vent openings 142. The conduits 150 extend through the insulative foam 160 and have their second ends 154 provided adjacent to or coupled to the water pump 120, the water heater 124, and/or the air blower 125 to carry heated exhaust air, i.e., cogenerated heat, from the water pump, the water heater, and/or the air blower through the conduits 150 to the cabinet 126. A hinge 144 pivotably couples the cabinet 126 to the enclosure 115, and the flexibility of conduits 150 permits the cabinet to open and close unhindered by the conduits. In addition, the cabinet 126 includes a plurality of hooks 140 (and/or bars) on which to hang towels.

Figure 4:
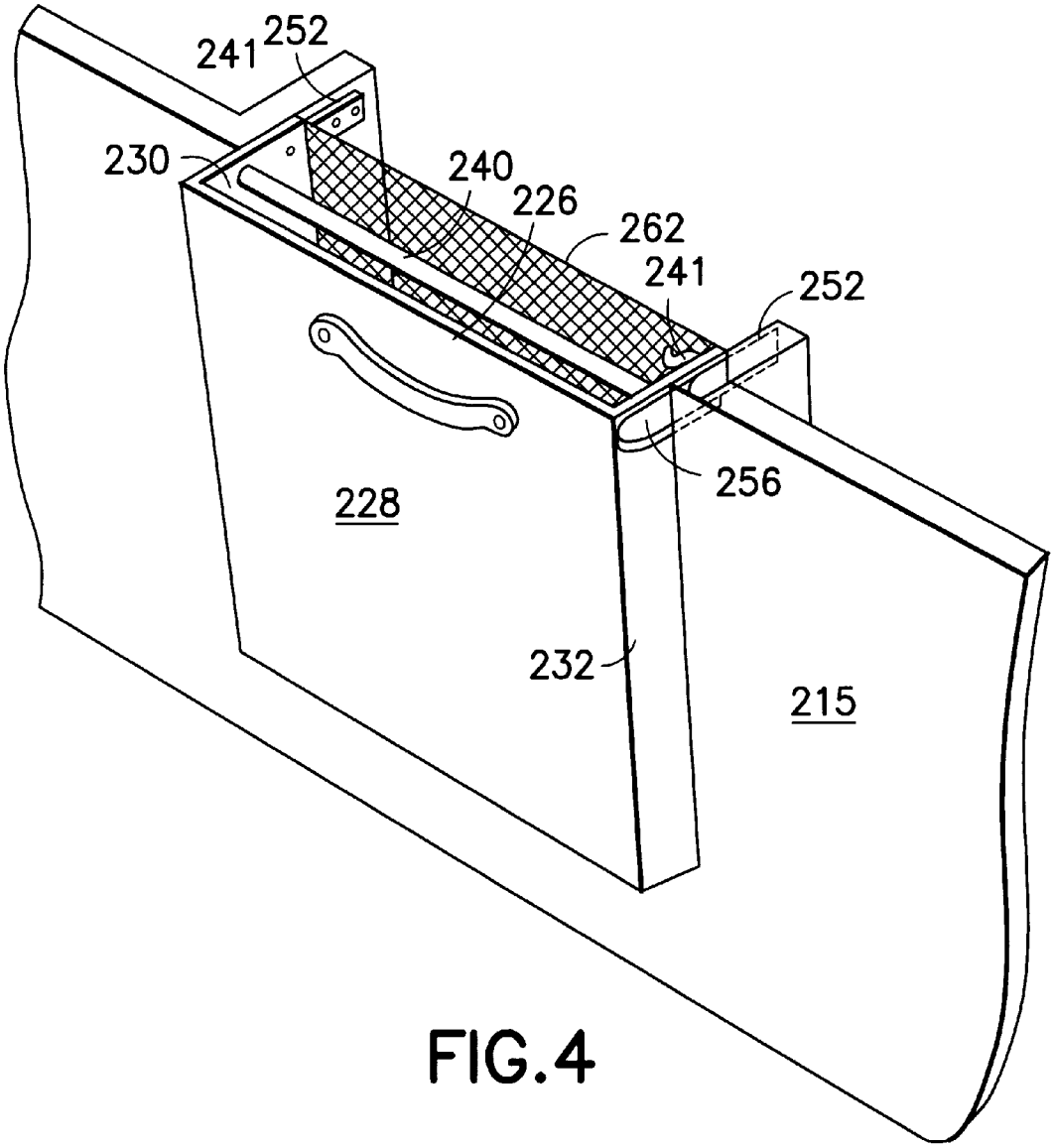
FIG. 4 is a partially broken-away perspective view of a third embodiment of a cabinet portion of a towel warming system according to the invention.

Referring now to FIG. 4, a third embodiment of a cabinet 226, substantially similar to the cabinet of the first embodiment, is shown. The cabinet 226 includes a combination of towel bars 240 and hooks 241 on which to hang towels. The cabinet 226 includes a front side 228 and lateral sides 230, 232, but is preferably provided with an air permeable mesh 262 in the back and bottom, and left open in the top to permit maximum contact between towels placed on the towel bars and hooks and the warm air within the space between the spa tub and the enclosure. The cabinet 226 is coupled to the enclosure 215 in a drawer-like manner; i.e, the enclosure 215 includes lateral bearings 252 and the cabinet 226 is provided with lateral channels 256 which extend over the bearings 252 and on which the cabinet moves in and out of the enclosure 215.

Figure 5:
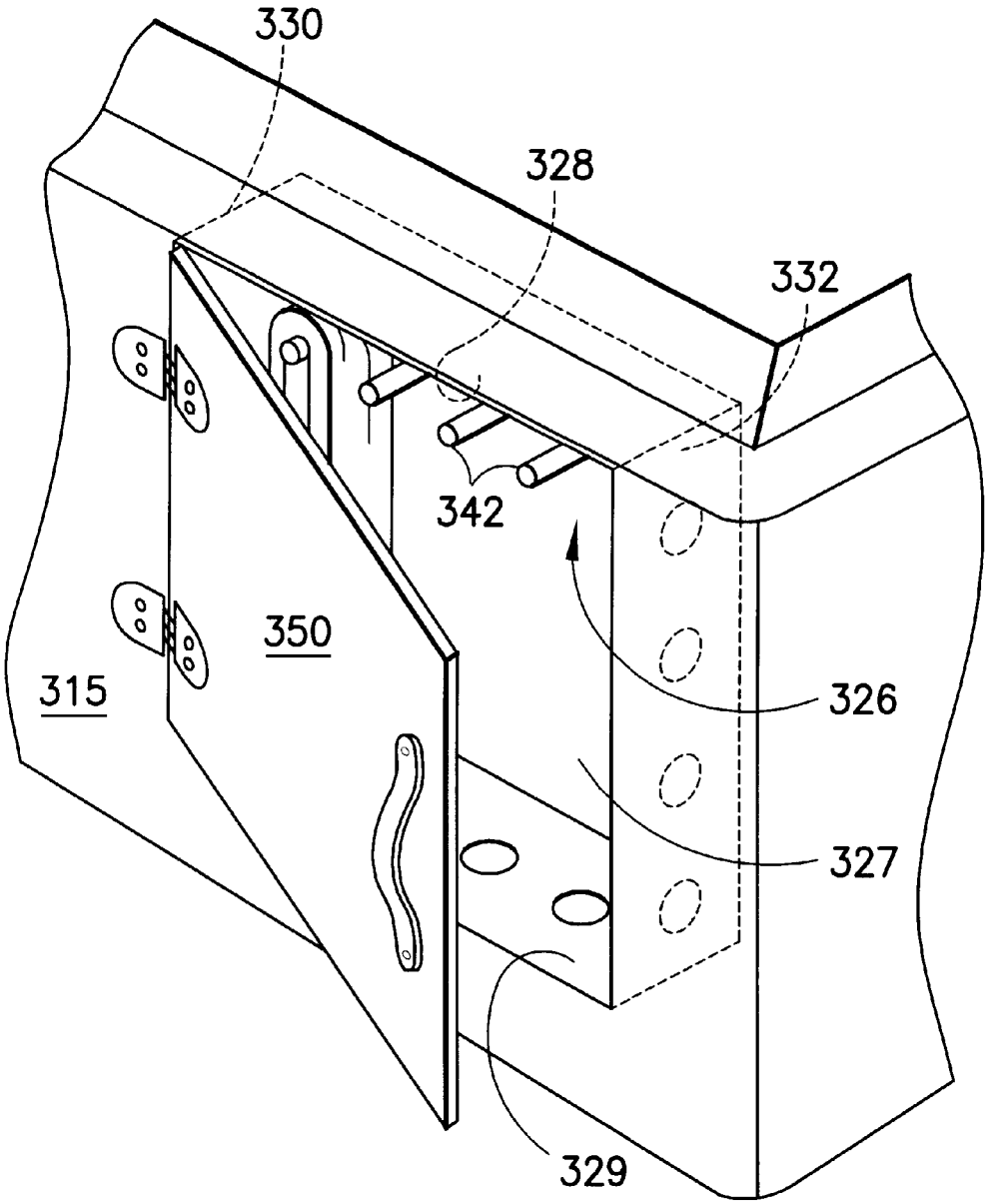
FIG. 5 is a partially broken-away perspective view of a fourth embodiment of a cabinet portion of a towel warming system according to the invention.

Turning now to FIG. 5, a fourth embodiment of a cabinet 326 is shown. The cabinet 326 is stationary and preferably includes a back side 327, top and bottom sides 328, 329, and lateral sides 330, 332. Several towel hanging devices such as towel bars 342 are provided in the cabinet, each preferably having a free end facilitating providing a towel therein. A door 350 is hingedly coupled to the enclosure 315 at one side of the cabinet to permit access to and closure of the cabinet.

Figure 6:
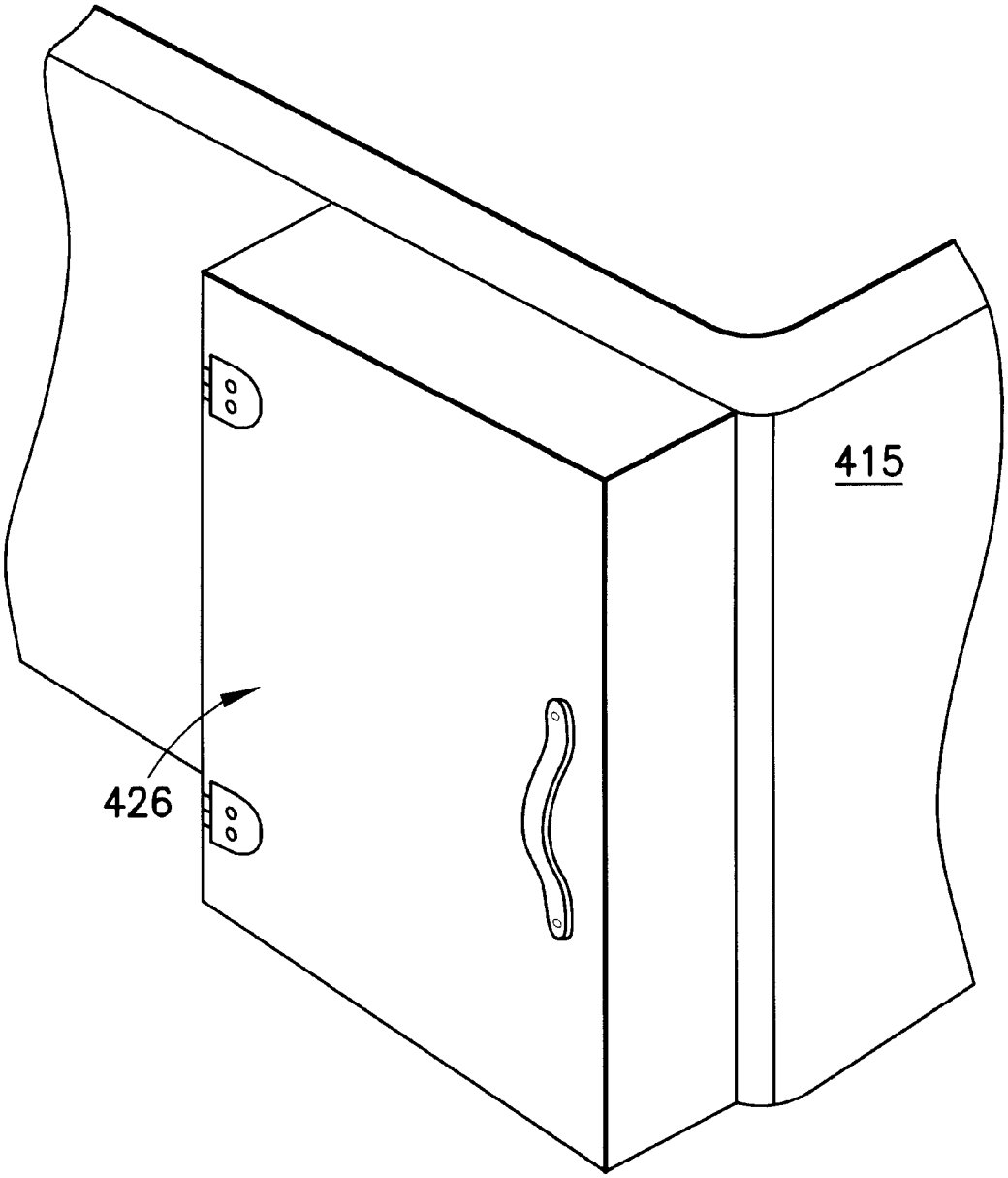
FIG. 6 is a partially broken-away perspective view of a fifth embodiment of a cabinet portion of a towel warming system according to the invention

Referring now to FIG. 6, a fifth embodiment of a cabinet 426 is shown. The cabinet 426 extends outward from the enclosure 415, and is particularly suitable for spa tub systems in which there is insufficient space between the spa tub and the enclosure for a towel cabinet which lies flush with the enclosure. in view of the other embodiments, it will be appreciated that the outwardly extending cabinet may take various configurations.

In each embodiment, a supply of towels may be kept in the cabinet or towels may be placed in the cabinet just prior to entering the spa tub. In all cases, after using the spa tub, the towels will be warm and comforting to the user.

There have been described and illustrated herein several embodiments of a towel warming system for spa tubs. While particular embodiments of the invention have been described, it is not intended that the invention be limited thereto, as it is intended that the invention be as broad in scope as the art will allow and that the specification be read likewise. Thus, while particular coupling means for coupling the cabinet to the enclosure have been disclosed, it will be appreciated that other coupling means can be used as well. Furthermore while particular types of towel hangers have been disclosed, it will be understood that other means for holding towels, e.g., discrete towel compartments, can be used. Moreover, while a cabinet and drawer have been disclosed for the towel warming system, it will be appreciated that other towel storage devices, e.g., a cabinet with a pair of center opening doors, may be used. In addition, wherever vent openings in a side of the cabinet have been disclosed, it will be appreciated that the side or a portion of the side may be replaced with mesh where structurally permissible. It will therefore be appreciated by those skilled in the art that yet other modifications could be made to the provided invention without deviating from its spirit and scope as so claimed.

What is claimed is:

1. A towel warming system, comprising:

a) a spa tub having an exterior, an interior adapted to be at least partially filled with water, and a plurality of water fixtures adapted to provide at least one of aerated water jets and bubbling air into water provided in said interior of said spa tub;

b) an enclosure substantially surrounding said exterior of said spa tub such that a space is provided between said spa tub and said enclosure, said enclosure provided with a towel storage device having an opening in communication with said space and means for holding a towel; and c) at least one of a water pump and a blower operating said fixtures, said at least one of said water pump and said blower being provided in said space and cogenerating heat when operational, wherein said towel storage device is adapted to receive the heat cogenerated through said opening and pass the heat over the towels provided in said towel storage device.

2. A towel warming system according to claim 1, wherein:

said towel storage device is movable at least partially into and out of said space between open and closed positions.

3. A towel warming system according to claim 1, wherein:

said towel storage device is coupled to said enclosure.

4. A towel warming system according to claim 1, wherein:

said towel storage device includes a front side and two lateral sides.

5. A towel warming system according to claim 4, wherein:

said towel storage device further includes a baok side and a bottom side, wherein at least one of said back side, said bottom side and said lateral sides includes at least one opening through which to receive the cogenerated heat.

6. A towel warming system according to claim 5, further comprising:

d) a conduit having first and second ends, said first end being coupled at or adjacent one of said at least one opening and said second end being positioned generally near said at least one of said water pump and said blower, such that heat generated by said at least one of said water pump and said blower travels through said conduit to said towel storage device.

7. A towel warming system according to claim 4, wherein:

said front side of said towel storage device is insulated.

8. A towel warming system according to claim 1, further comprising:

d) a water heater for heating said water, said water heater cogenerating heat which enters into said towel storage device.

9. A towel warming system according to claim 1, wherein:

said means for holding a towel includes at least one towel bar.

10. A towel warming system according to claim 1, further comprising:

d) a towel provided in said towel storage device.

11. A towel warming system according to claim 1, wherein:

said towel warming system includes a front side which is flush with said enclosure.

12. A towel warming system according to claim 1, wherein:

said towel storage device includes a front side, and at least one lateral side which extends outward from said enclosure.

13. A towel warming system according to claim 1, wherein:

said space is at least partially filled with insulation.

14. A towel warming system for a spa system including a tub having an interior adapted to be at least partially filled with water, an exterior surface, water fixtures adapted to provide at least one of aerated water jets and bubbling air into water provided in said interior of said spa tub, and at least one of a water pump and a blower operating said fixtures, said towel warming system comprising:

a) an enclosure adapted to substantially surround the exterior surface of the tub such that a space is provided between the tub and said enclosure with the at least one of the water pump and the blower being provided in said space; and b) a towel storage device in communication with said space and including means for holding a towel, wherein when said towel storage device is in a closed position heat generated by the pump passess through said towel storage device and over towels provided therein.

15. A towel warming system according to claim 14, wherein:

said towel storage device includes a front side, and at least one lateral side which extends outward from said enclosure.

16. A towel warming system according to claim 14, wherein:

said towel storage device is movable at least partially into and out of said space between open and closed positions.

17. A towel warming system according to claim 16, wherein:

said towel storage device is coupled to said enclosure.

18. A towel warming system according to claim 16, wherein:

said towel storage device includes a front side which is flush with said enclosure.

19. A towel warming system according to claim 14, wherein:

said towel storage device includes a front side and two lateral sides.

20. A towel warming system according to claim 19, wherein:

said towel storage device further includes a back side and a bottom side, wherein at least one of said back side, said bottom side and said lateral sides includes at least one opening.

21. A towel warming system according to claim 20, wherein:

said opening is provided with a mesh.

22. A towel warming system according to claim 20, further comprising:

d) a conduit having first and second ends, said first end being coupled to one of said at least one opening and said second end being adapted to be positioned generally near the at least one of the water pump and the blower, such that heat generated by the at least one of the water pump and the blower travels through said conduit to said towel storage device.

23. A towel warming system according to claim 14, wherein:

said space is at least partially filled with insulation.

24. A towel warming system according to claim 14, wherein:

said means for holding a towel includes at least one towel bar.

25. A towel warming system according to claim 14, further comprising:

d) a water heater in said space and adapted to heat the water, said water heater cogenerating heat which enters into said towel storage device.

26. In a spa tub having a plurality of fixtures which provide at least one of aerated water jets and air bubbles into an interior of the tub, an enclosure substantially surrounding an exterior surface of the tub such that a space is provided between the exterior surface of the spa tub and the enclosure, and at least one of a water pump and a blower provided in said space and coupled to each of the plurality of fixtures to operate the plurality of fixtures, an improvement comprising:

a towel storage device in communication with the space between the enclosure and the exterior of the tub such that heat air circulating within the space is permitted to circulate through said towel storage device and pass over a towel provided in said towel storage device, said towel storage device including means for holding the towel.

* * * * *